US010727614B2

(12) United States Patent
Ochi

(10) Patent No.: US 10,727,614 B2
(45) Date of Patent: Jul. 28, 2020

(54) WIRE CONNECTING DEVICE

(71) Applicant: DENSO CORPORATION, Kariya, Aichi-pref. (JP)

(72) Inventor: Kenji Ochi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/274,577

(22) Filed: Feb. 13, 2019

(65) Prior Publication Data

US 2019/0326687 A1 Oct. 24, 2019

(30) Foreign Application Priority Data

Apr. 19, 2018 (JP) ..... 2018-80809

(51) Int. Cl.

| | |
|---|---|
| ***H01R 13/58*** | (2006.01) |
| ***H01R 4/2433*** | (2018.01) |
| ***H01R 4/2437*** | (2018.01) |
| ***H01R 13/405*** | (2006.01) |
| *H01R 13/11* | (2006.01) |

(52) U.S. Cl.

CPC ..... *H01R 4/2433* (2013.01); *H01R 4/2437* (2013.01); *H01R 13/405* (2013.01); *H01R 13/58* (2013.01); *H01R 13/112* (2013.01)

(58) Field of Classification Search

CPC ..... H01R 4/24; H01R 4/2404; H01R 4/2406; H01R 4/2407; H01R 4/2408; H01R 4/2412; H01R 4/2416; H01R 4/242; H01R 4/2425; H01R 4/2429; H01R 4/2433; H01R 4/2437; H01R 4/2441; H01R 4/2445; H01R 4/245; H01R 4/2452; H01R 4/2454; H01R 4/2456; H01R 4/2458; H01R 4/2462; H01R 4/2466; H01R 4/247; H01R 4/2475; H01R 4/2479; H01R 4/2483; H01R 4/2487; H01R 4/2491; H01R 4/2495; H01R 4/26; H01R 13/405; H01R 13/58; H01R 13/112

See application file for complete search history.

(56) References Cited

U.S. PATENT DOCUMENTS 3,950,062 A * 4/1976 Reavis, Jr. ..... H01R 4/2425 439/408
4,136,920 A * 1/1979 Scholtholt ..... H01R 4/2462 439/395

(Continued)

*Primary Examiner* — Edwin A. Leon
*Assistant Examiner* — Milagros Jeancharles
(74) *Attorney, Agent, or Firm* — Posz Law Group, PLC

(57) ABSTRACT

A terminal holder unit of a wire connecting device includes a terminal accommodation space and a holder-side groove penetrating a wall of a holder base portion of the terminal holder unit in a wire extending direction. A covered electric wire is inserted into the holder-side groove. A press-insert terminal is inserted into the holder-side groove in a terminal insertion direction. A part of an insulating coating portion of the wire is removed, when cutting portions of the press-insert terminal are press-contacted to the wire. A part of a conductive wire portion of the wire is exposed to an outside of the wire, so that the press-insert terminal is electrically connected to the wire. A pair of wire stopper portions is formed in the holder base portion at both sides of the holder-side groove for limiting a movement of the wire in a direction from a wire assembled position to an open end of the holder-side groove.

5 Claims, 17 Drawing Sheets

(56) References Cited

U.S. PATENT DOCUMENTS 4,220,390 A * 9/1980 Cobaugh ..... H01R 4/2462 439/401
4,256,360 A * 3/1981 Debaigt ..... H01R 4/242 439/399
4,262,984 A * 4/1981 Takahashi ..... H01R 4/2445 439/405
4,333,700 A * 6/1982 Pugh, III ..... H01R 4/2425 439/403
4,381,880 A * 5/1983 Pohl ..... H01R 4/2416 439/402
4,448,473 A * 5/1984 Felix ..... H01R 12/675 439/409
4,548,459 A * 10/1985 Mosser, III ..... H01R 4/2462 439/395
4,600,259 A * 7/1986 Olsson ..... H01R 12/675 439/398
4,820,179 A * 4/1989 Saijo ..... H01R 4/2466 439/224
4,861,278 A * 8/1989 McBride ..... H01R 4/2416 439/395
4,869,685 A * 9/1989 Olsson ..... H01R 12/675 439/404
5,423,694 A * 6/1995 Jensen ..... H01R 4/2408 439/402
5,492,484 A * 2/1996 Archer ..... H01R 4/2429 439/395
5,759,061 A * 6/1998 Jensen ..... H01R 4/2416 439/400
5,827,087 A * 10/1998 Yamasaki ..... H01R 4/2425 439/395
6,036,527 A * 3/2000 White ..... H01R 4/2437 439/395
7,458,840 B2 * 12/2008 Pratt ..... H01R 4/2433 439/409
8,083,538 B2 * 12/2011 Ofenloch ..... H01R 4/2462 439/404
8,708,733 B2 * 4/2014 Parrish ..... H01R 4/242 439/395
2004/0077208 A1 * 4/2004 Brown ..... H01R 4/242 439/395
2004/0240227 A1 12/2004 Asao et al.
2006/0089040 A1 * 4/2006 Pratt ..... H01R 4/2433 439/409
2010/0068916 A1 * 3/2010 Chen ..... H01R 4/2429 439/391
2012/0154085 A1 * 6/2012 Canepa-Anson .... F02M 51/005 335/299
2014/0310953 A1 * 10/2014 McCaskey ..... H01R 43/015 29/749
2015/0111438 A1 4/2015 Yamamoto et al.

* cited by examiner

WIRE CONNECTING DEVICE

CROSS REFERENCE TO RELATED APPLICATION

This application is based on Japanese Patent Application No. 2018-80809 filed on Apr. 19, 2018, the disclosure of which is incorporated herein by reference.

FIELD OF TECHNOLOGY

The present disclosure relates to a wire connecting device.

BACKGROUND

In one of wire connecting devices of a prior art, a press-insert terminal is inserted into a terminal accommodation space of a terminal holder unit. A covered electric wire is inserted into a holder-side groove and then the press-insert terminal is press inserted into the terminal accommodation space. A part of an insulating coating portion of the wire is removed when the press-insert terminal is inserted into the terminal accommodation space, so that the press-insert terminal is electrically connected to the covered electric wire.

However, in the wire connecting device of the above prior art, the covered electric wire is not stably held in the holder-side groove and not firmly maintained at its wire assembled position.

SUMMARY OF THE DISCLOSURE

It is an object of the present disclosure to provide a wire connecting device, according to which a covered electric wire can be surely and stably held at its wire assembled position.

According to one of features of the present disclosure, wire stopper portions are formed in a holder base portion of a terminal holder unit, so that a covered electric wire is inserted into a holder-side groove of the terminal holder unit and firmly held by the wire stopper portions at a wire assembled position.

According to another feature of the present disclosure, wire stopper portions are formed in a press-insert terminal, so that a covered electric wire is firmly held at a wire assembled position by the wire stopper portions formed in the press-insert terminal.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION OF THE EMBODIMENTS

Figure 1:
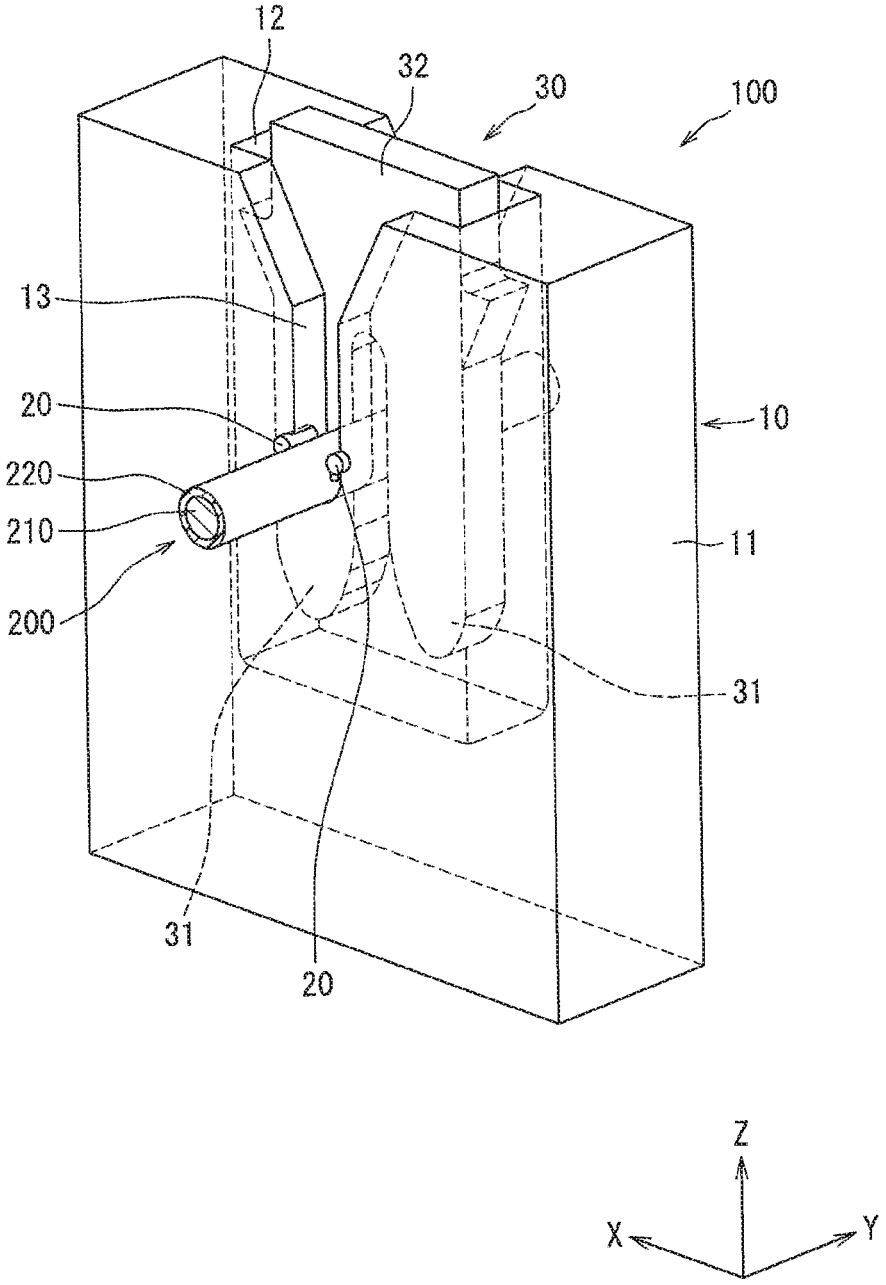
FIG. 1 is a schematic perspective view showing a wire connecting device according to a first embodiment of the present disclosure.

The present disclosure will be explained hereinafter by way of multiple embodiments and/or modifications with reference to the drawings. The same reference numerals are given to the same or similar structures and/or portions in order to avoid repeated explanation.

In the present disclosure, each of three directions which are respectively crossing at right angle is indicated by "X", "Y" and "Z". An X-direction is also referred to as "a stopper arranged direction". A Y-direction is also referred to as "a wire extending direction". A Z-direction is also referred to as "a terminal insertion direction". A plane defined by the X-direction and the Y-direction is referred to as "an X-Y plane", while a plane defined by the X-direction and the Z-direction is referred to as "an X-Z plane".

First Embodiment

A wire connecting device 100 of a first embodiment will be explained with reference to FIGS. 1 to 5. The wire connecting device 100 is a device using an electric connecting technology, which is a so-called IDC (Insulation Displacement Connection). In the wire connecting device 100, a process for removing a part of an insulating coating portion 220 of a covered electric wire 200 and a process for electrically connecting a press-insert terminal 30 to the covered electric wire 200 are carried out at the same time, when the press-insert terminal 30 is press-inserted into a terminal accommodation space 12 of a terminal holder unit 10.

Figure 2:
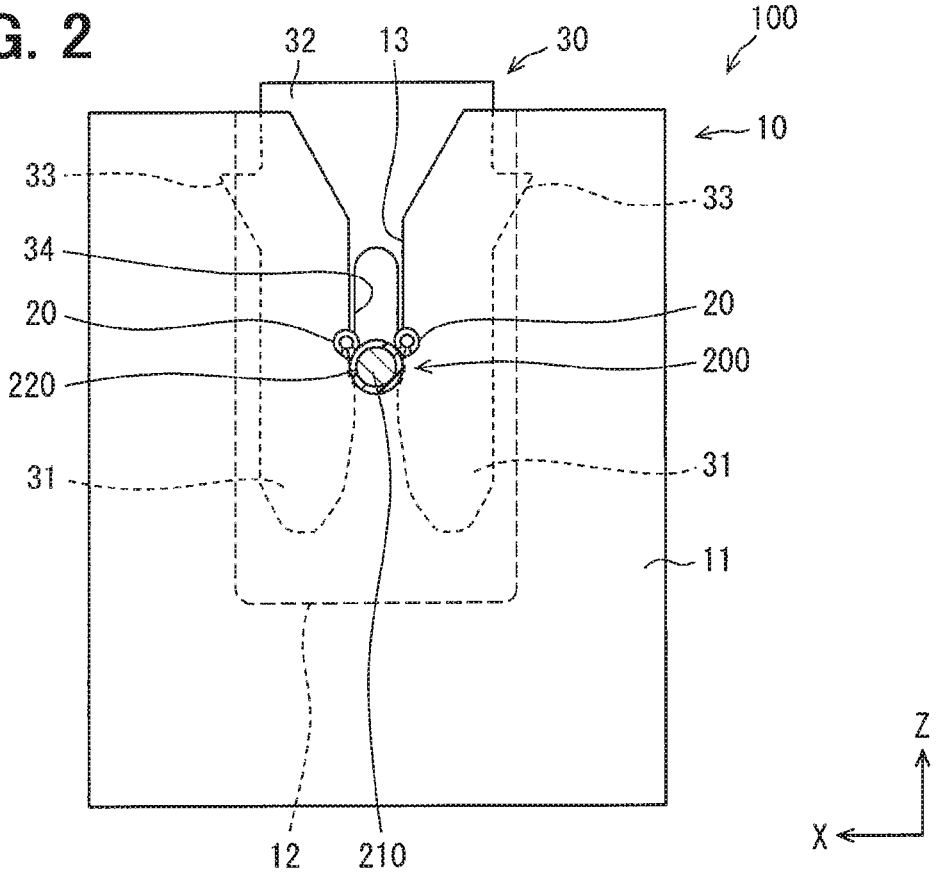
FIG. 2 is a schematic front view showing the wire connecting device of the first embodiment.

As shown in FIGS. 1 and 2, the covered electric wire 200 includes a conductive wire portion 210 of a rod shape and the insulating coating portion 220 covering the conductive wire portion 210. As explained more in detail below, the part of the insulating coating portion 220 is removed by the press-insert terminal 30 and the conductive wire portion 210 is thereby electrically connected to the press-insert terminal 30. In the drawings of FIG. 1 and so on, a cross section of the covered electric wire 200 is shown.

As shown in FIGS. 1 to 5, the wire connecting device 100 includes the terminal holder unit 10, multiple wire stopper portions 20, the press-insert terminal 30, and so on. The terminal holder unit 10 surely and stably holds the covered electric wire 200 at its wire assembled position (explained below). The terminal holder unit 10 is made of resin material and includes a holder base portion 11, the terminal accommodation space 12, a pair of holder-side grooves 13 and so on.

The terminal accommodation space 12 is a recessed portion formed in the holder base portion 11 and extending in the Z-direction (the terminal insertion direction) in parallel to the X-Z plane of the holder base portion 11. The holder base portion 11 has a front-side wall portion and a rear-side wall portion opposing to each other across the terminal accommodation space 12 in the Y-direction (the wire extending direction). The terminal accommodation space 12 accommodates the press-insert terminal 30, when it is assembled to the terminal holder unit 10. In other words, the terminal accommodation space 12 is a hole having a closed bottom end and accommodating the press-insert terminal 30 in the Z-direction. The holder base portion 11 has an inner wall surface S2 defining the terminal accommodation space 12 and an outer wall surface S1, which is an outer surface of the holder base portion 11 opposite to the inner wall surface S2 in the Y-direction. The terminal accommodation space 12 is also referred to as a terminal insertion hole.

Figure 3:
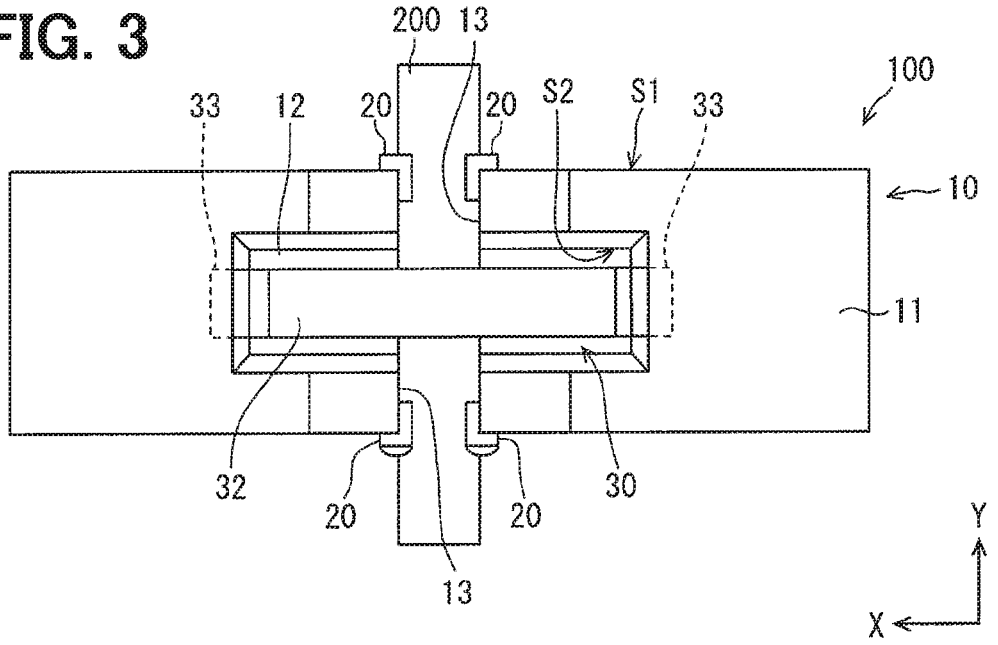
FIG. 3 is a schematic top plane view showing the wire connecting device of the first embodiment.

The holder-side groove 13 is a groove extending in the Z-direction in parallel to the X-Z plane of the holder base portion 11. The holder-side groove 13 is formed in each of the front-side wall portion and the rear-side wall portion of the holder base portion 11. Each of the holder-side grooves 13 penetrates the front-side and the rear-side wall portions of the holder base portion 11 in the Y-direction from the outer wall surface S1 to the inner wall surface S2. Each of the holder-side grooves 13 is connected to the terminal accommodation space 12. The covered electric wire 200 is inserted into the terminal accommodation space 12 in the Z-direction and arranged in the terminal accommodation space 12 and the holder-side grooves 13 in the Y-direction. As shown in FIGS. 2 and 3, the covered electric wire 200 extending in the Y-direction is inserted into the holder-side grooves 13 in the Z-direction, so that the covered electric wire 200 is interposed between inside opposing walls of the holder-side groove 13 opposed to each other in the X-direction (the stopper arranged direction).

As shown in FIGS. 1 and 2, each of the holder-side grooves 13 has a bottom portion with a curved surface. The holder-side groove 13 is also referred to as a U-shaped groove. An upper-side portion of the holder-side groove 13 has a Y-letter shape on the X-Z plane, so that a width of the holder-side groove 13 in the X-direction becomes larger in the Z-direction from the bottom portion to an upper-side open end. As a result, the covered electric wire 200 can be smoothly inserted into the holder-side grooves 13 in the Z-direction.

As shown in FIGS. 2 and 3, a pair of wire stopper portions 20 is provided in the holder base portion 11 at both sides of the holder-side groove 13 in the X-direction for limiting a movement of the covered electric wire 200 in the Z-direction from the bottom portion (that is, the wire assembled position) to the upper-side open end of the holder-side groove 13. As shown in FIG. 3, one pair of the wire stopper portions 20 is provided at the front-side wall portion of the holder base portion 11, while another pair of the wire stopper portions 20 is provided at the rear-side wall portion of the holder base portion 11. Therefore, in the present embodiment, four wire stopper portions 20 are provided in total. As shown in FIG. 2, the wire stopper portions 20 in each pair are opposed to each other in the X-direction across the holder-side groove 13. In the present embodiment, each of the wire stopper portions 20 is composed of a bar-shaped member having a circular cross section on the X-Z plane.

Figure 4:
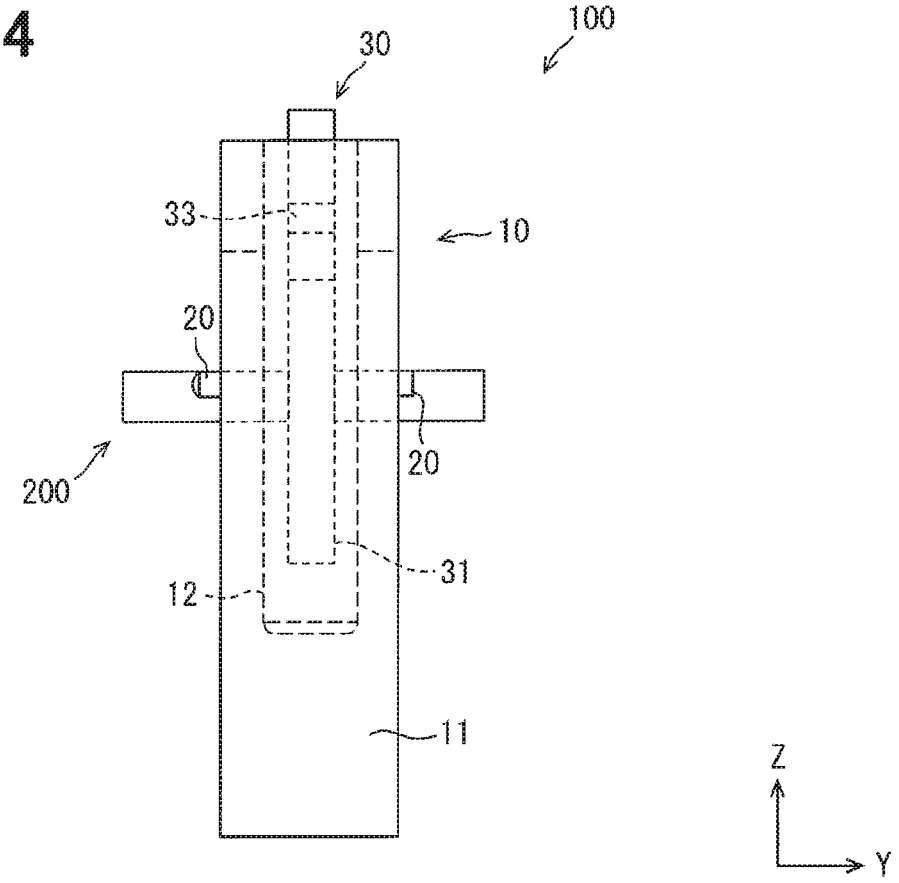
FIG. 4 is a schematic side view showing the wire connecting device of the first embodiment.

As shown in FIGS. 3 and 4, a forward end of the wire stopper portion 20 is outwardly protruded from the outer wall surface S1 of the holder base portion 11 in the Y-direction. A rear end of the wire stopper portion 20 is extending to the holder-side groove 13 in the Y-direction. A distance between the neighboring wire stopper portions 20 (a distance between radial-inside surface points of the respective wire stopper portions 20) of each pair in the X-direction is made to be smaller than the width of the holder-side groove 13. As above, the wire connecting device 100 has the wire stopper portions 20, each of which is outwardly protruded from the outer wall surface S1 of the holder base portion 11.

As above, the forward end of each wire stopper portion 20 is outwardly protruded from the outer wall surface S1 in the Y-direction, while a radial-inside part of the wire stopper portion 20 is inwardly protruded into the holder-side groove 13 in the X-direction. Since the forward end of each wire stopper portion 20 is outwardly protruded in the Y-direction, a contact area between the covered electric wire 200 and the wire connecting device 100 (including the bottom portion of the holder-side groove 13 and the wire stopper portion 20) in the Y-direction becomes larger, when compared with a case in which the wire stopper portions 20 are not provided.

In addition, each of the wire stopper portions 20 is provided at such a position, at which the wire stopper portions 20 can limit the movement of the covered electric wire 200 in the Z-direction from the wire assembled position to the upper-side open end of the holder-side groove 13. In other words, each of the wire stopper portions 20 is located at a position, which is separated in the Z-direction from a bottom end of the holder-side groove 13 by a distance smaller than a diameter of the covered electric wire 200. For example, a virtual line connecting center axes of the neighboring wire stopper portions 20 in the X-direction is located at such a position that a distance in the Z-direction between the virtual line and the bottom end of the holder-side groove 13 is equal to or smaller than the diameter of the covered electric wire 200. Accordingly, the wire stopper portions 20 are provided at such positions, at which the wire stopper portions 20 can push the covered electric wire 200 in the Z-direction to the bottom end of the holder-side groove 13.

As shown in FIG. 3, in the present embodiment, the rear end of the wire stopper portion 20 is located in the holder-side groove 13, while the forward end of the wire stopper portion 20 is outwardly protruded from the outer wall surface S1 of the holder base portion 11. In the present embodiment, each pair of the wire stopper portions 20 is respectively provided for the holder-side groove 13 at each of the front-side and the rear-side wall portions of the holder base portion 11. However, the present disclosure is not limited to the above structure of the first embodiment shown in FIG. 3. For example, the rear end of the wire stopper portion 20 is not necessarily located in the holder-side groove 13. Furthermore, the wire stopper portions 20 may be provided only at one of the front-side and the rear-side wall portions of the holder base portion 11.

In addition, in the terminal holder unit 10 of the present embodiment, the wire stopper portions 20 are integrally formed with the holder base portion 11. However, the present disclosure is not limited thereto. The wire stopper portions 20 may be made of separate parts from the holder base portion 11. Namely, the terminal holder unit 10 may be composed of the holder base portion 11 and the wire stopper portions 20, which are made of independent parts from each other and assembled to one unit. More exactly, for example, recessed portions may be formed in the holder base portion 11 and each of the wire stopper portions 20 may be inserted into and fixed to each of the recessed portions. Alternatively, each of the wire stopper portions 20 may be fixed to the recessed portion by adhesive material.

In the case that the holder base portion 11 and the wire stopper portions 20 are made of independent parts from each other, a metallic molding die unit for molding the holder base portion 11 with resin is composed of, for example, two molding dies including an upper molding die and a lower molding die. Therefore, it is possible to easily manufacture the holder base portion 11 having no wire stopper portions 20, compared with the case in which the holder base portion 11 and the wire stopper portions 20 are integrally formed by the resin molding process.

Figure 5:
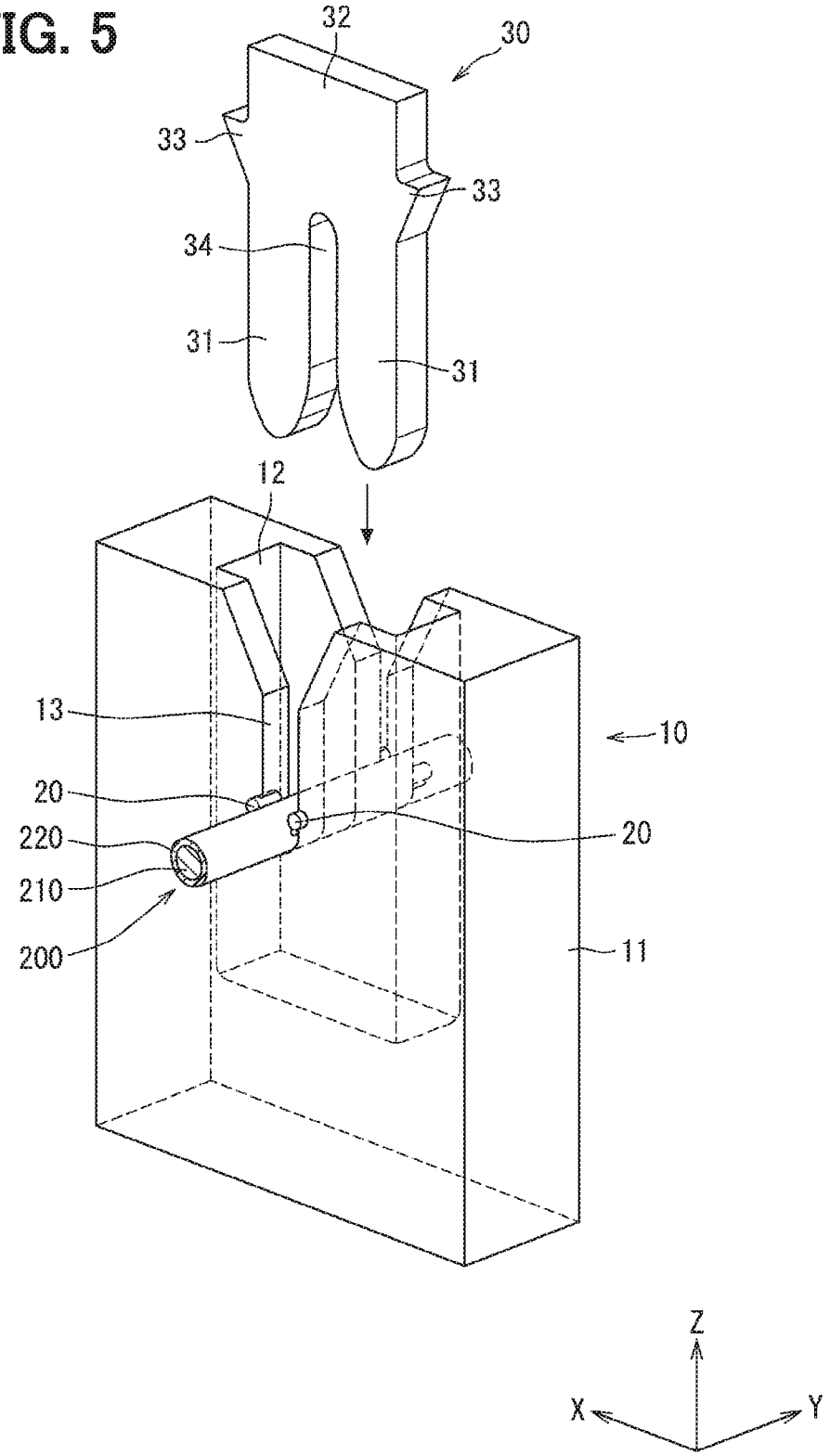
FIG. 5 is a schematic perspective view showing an assembling process for the wire connecting device of the first embodiment.

As shown in FIG. 5, the press-insert terminal 30 is made of electrically conductive material and has a pair of cutting portions 31. More exactly, the press-insert terminal 30 includes a connecting portion 32 for connecting the cutting portions 31 to each other, a pair of terminal stopper portions 33, a terminal-side groove 34 and so on. In the press-insert terminal 30, the cutting portions 31, the connecting portion 32 and the terminal stopper portions 33 are integrally formed as one member. The press-insert terminal 30 is formed in a fork shape having two cutting portions 31, each of which is divided and extending in the Z-direction from the connecting portion 32.

In the press-insert terminal 30, each of the cutting portions 31 is opposed to each other in the X-direction across the terminal-side groove 34. In a condition that the press-insert terminal 30 is inserted into the terminal holder unit 10, the covered electric wire 200 is held in the terminal-side groove 34. Accordingly, the covered electric wire 200 is interposed between the cutting portions 31 in the X-direction, in the condition that the press-insert terminal 30 is assembled to the holder base portion 11 of the terminal holder unit 10.

As indicated by an arrow in FIG. 5, the press-insert terminal 30 is inserted into the terminal accommodation space 12 of the terminal holder unit 10 in a condition that the covered electric wire 200 is already inserted into the holder-side grooves 13 of the terminal holder unit 10. More exactly, when the press-insert terminal 30 is inserted into the terminal accommodation space 12, the terminal stopper portions 33 of the press-insert terminal 30 are inwardly pressed by the inner wall surface S2 of the holder base portion 11 in the X-direction while the terminal stopper portions 33 slide on the inner wall surface S2 in the Z-direction. Then, the press-insert terminal 30 is firmly connected to the holder base portion 11 of the terminal holder unit 10. When the press-insert terminal 30 is inserted into the terminal accommodation space 12, either one of or each one of the press-insert terminal 30 and the holder base portion 11 is moved in such a way that they come closer to each other in the Z-direction. In other words, instead of the press-insert terminal 30, the holder base portion 11 of the terminal holder unit 10 may be moved in the direction to the press-insert terminal 30 in order to accommodate the press-insert terminal 30 in the terminal accommodation space 12.

In addition, stopper concave portions may be additionally formed at the inner wall surface S2 of the holder base portion 11 so that each of the terminal stopper portions 33 is engaged with the respective stopper concave portion. As a result, the press-insert terminal 30 is firmly held in the terminal accommodation space 12. In this case, the press-insert terminal 30 is pressed into the terminal accommodation space 12 until the terminal stopper portions 33 are engaged with the stopper concave portions. Accordingly, it is possible to surely prevent the press-insert terminal 30 from being pulled out from the terminal accommodation space 12.

When the press-insert terminal 30 is inserted into the terminal accommodation space 12, each of the cutting portions 31 is strongly pressed to the covered electric wire 200 held in the holder-side groove 13 of the terminal holder unit 10 and a part of the insulating coating portion 220 is removed. As a result, the press-insert terminal 30 is electrically connected to the conductive wire portion 210, at which the part of the insulating coating portion 220 is removed and the part of the conductive wire portion 210 is exposed to the outside of the covered electric wire 200. Accordingly, the press-insert terminal 30 is electrically connected to the conductive wire portion 210 of the covered electric wire 200 in the condition that the press-insert terminal 30 is firmly fixed to the terminal holder unit 10. As above, in the wire connecting device 100, the covered electric wire 200 is held at the wire assembled position between the press-insert terminal 30 and the terminal holder unit 10, so that the covered electric wire 200 is mechanically and electrically connected to the terminal holder unit 10.

For example, in FIG. 1 and other drawings, the press-insert terminal 30 is so indicated that the press-insert terminal 30 is in contact with the insulating coating portion 220 of the covered electric wire 200, for the purpose of simplicity. However, in the real wire connecting device 100, the press-insert terminal 30 is mechanically and electrically in contact with the conductive wire portion 210 at a portion at which the part of the insulating coating portion 220 is removed, in the condition that the cutting portions 31 of the press-insert terminal 30 are inserted into the terminal holder unit 10. Therefore, the cutting portion 31 is partly buried in the insulating coating portion 220. This condition is the same to those of the other embodiments of the present disclosure.

As above, in the wire connecting device 100, the covered electric wire 200 is stably held at the wire assembled position and supported by the holder-side grooves 13 of the terminal holder unit 10. The wire stopper portions 20 are provided in the holder base portion 11 at both sides of the holder-side groove 13 in the X-direction, in order to prevent the covered electric wire 200 assembled to the terminal holder unit 10 from moving in the Z-direction from the wire assembled position to the upper-side open end of the holder-side groove 13. The distance between the neighboring wire stopper portions 20 in the X-direction is smaller than the width of the holder-side groove 13. Accordingly, in the wire connecting device 100, it is possible to prevent the covered electric wire 200 from moving from the wire assembled position in the holder-side groove 13 to the upper-side open end thereof.

In addition, in the wire connecting device 100, the wire stopper portion 20 is so provided in the holder base portion 11 that it is outwardly protruded from the outer wall surface S1 in the wire extending direction (the Y-direction).

When compared the present embodiment with a comparison example in which a wire stopper portion has only a rear end not protruding in a front-side direction but extending in a rear-side direction of the Y-direction (namely, the wire stopper portion is located only in the holder-side groove 13), it is possible in the present embodiment to make a Y-direction distance longer, wherein the Y-direction distance is a distance in the Y-direction from the wire stopper portion to a press-contact portion of the covered electric wire 200 at which the cutting portions 31 are press-contacted to the covered electric wire 200.

As a result, the wire connecting device 100 of the present embodiment can withstand a larger displacement of the covered electric wire 200, when compared with the above comparison example in which the wire stopper portions are not outwardly protruded from the outer wall surface S1. In other words, it is possible to increase a holding force of the wire connecting device 100, in which the covered electric wire 200 is placed and held at the bottom portion of the holder-side grooves 13 (the wire assembled position).

Generally, the covered electric wire 200 has low stiffness and is easily displaced from the wire assembled position due to vibration, a difference between expansion and contraction by a cold-heat cycle, or the like. Therefore, it may happen in the wire connecting device 100 that the contacting surface between the press-insert terminal 30 and the covered electric wire 200 may be moved or fatigue may be produced. However, since the wire connecting device 100 of the present embodiment can absorb the above large displacement of the covered electric wire 200, it is possible to prevent the contacting surface between the covered electric wire 200 and the press-insert terminal 30 from being moved and a stress to be generated can be reduced.

In addition, since it is possible in the wire connecting device 100 of the present embodiment to prevent the possible positional displacement of the covered electric wire 200 by the wire stopper portions 20, it is possible to prevent the wire connecting device 100 from becoming larger in size. Accordingly, it is possible in the wire connecting device 100 to make an occupying space smaller and to thereby realize a saving of the space.

Second Embodiment

A wire connecting device 101 of a second embodiment will be explained with reference to FIGS. 6 and 7. The wire connecting device 101 of the second embodiment is different from the wire connecting device 100 of the first embodiment in a structure of a wire stopper portion 21.

Figure 6:
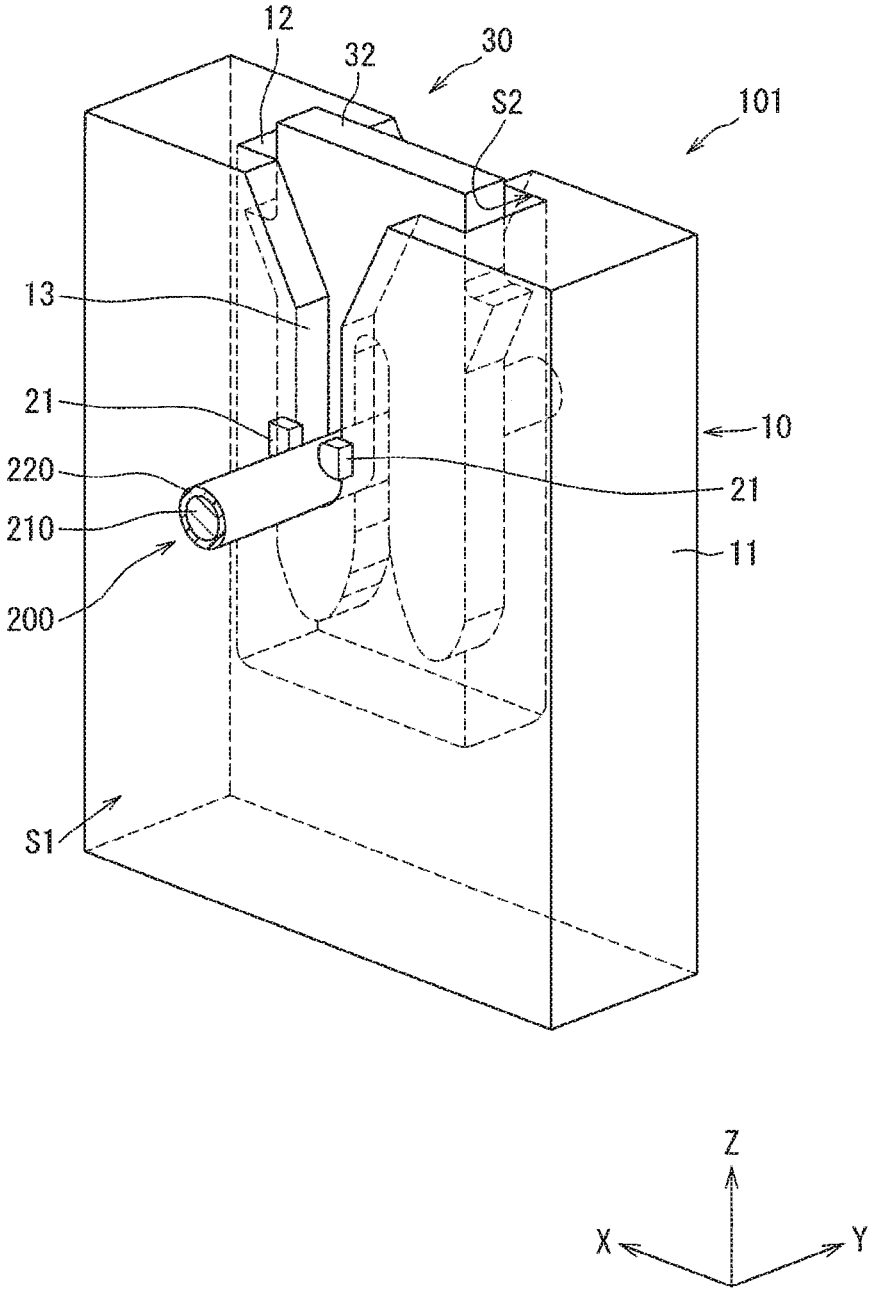
FIG. 6 is a schematic perspective view showing a wire connecting device according to a second embodiment of the present disclosure.
Figure 7:
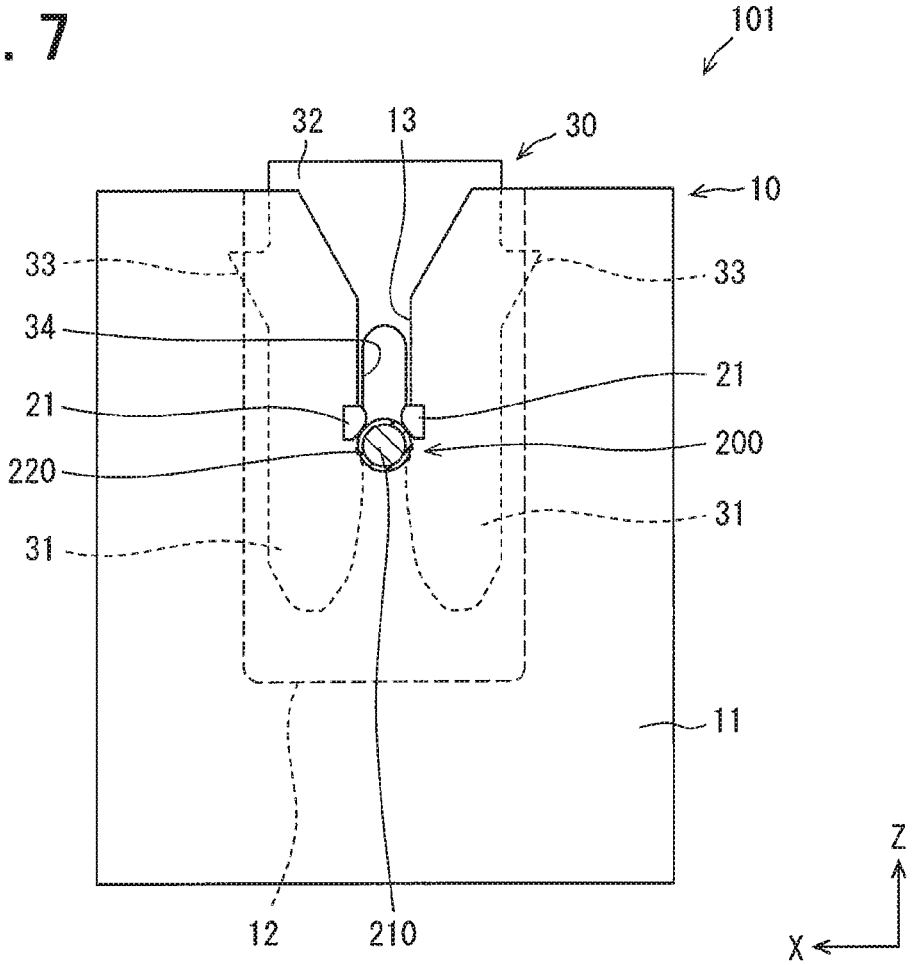
FIG. 7 is a schematic front view showing the wire connecting device of the second embodiment.

As shown in FIGS. 6 and 7, the wire stopper portions 21 are provided at the outer wall surface S1 of the holder base portion 11. Each of the wire stopper portions 21 is outwardly protruded from the outer wall surface S1 in the Y-direction but not going into the inside of the holder-side groove 13 in the Y-direction. The wire stopper portion 21 may be integrally formed with the holder base portion 11 of the terminal holder unit 10. Alternatively, the wire stopper portion 21 may be formed as a separate part from the holder base portion 11 and may be fixed to the holder base portion 11 by adhesive material.

As shown in FIG. 7, the wire stopper portions 21 are provided at both sides of the holder-side groove 13 in the X-direction, wherein a radial-inside opposing surface of each wire stopper portion 21 is formed with a curved surface. A curvature radius of an upper-side curved surface (on a side closer to the upper-side open end of the holder-side groove 13) is made to be different from a curvature radius of a lower-side curved surface (on a side closer to the bottom end of the holder-side groove 13). More exactly, the curvature radius of the upper-side curved surface is made to be smaller than that of the lower-side curved surface, when viewed them in the Y-direction.

The wire connecting device 101 of the second embodiment can obtain the same advantages to those of the first embodiment. Since the wire stopper portion 21 is not inwardly protruded into the inside of the holder-side groove 13 in the Y-direction of the wire connecting device 101, it is possible to manufacture the wire connecting device 101 (in particular, the terminal holder unit 10) more easily than the wire connecting device 100 of the first embodiment.

Third Embodiment

A wire connecting device 102 of a third embodiment will be explained with reference to FIGS. 8 and 9. The wire connecting device 102 of the third embodiment is different from the wire connecting device 100 of the first embodiment in a structure of a wire stopper portion 22.

Figure 8:
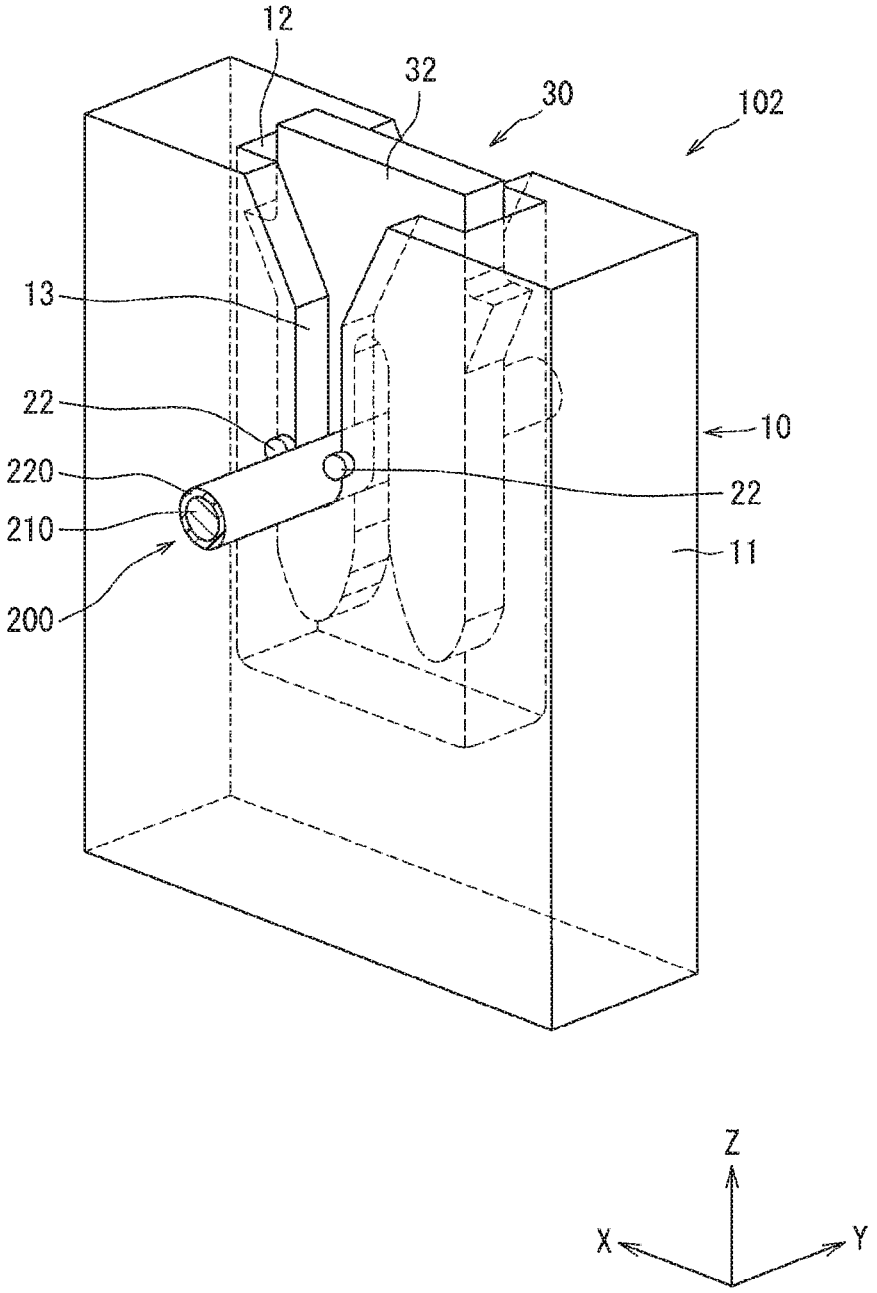
FIG. 8 is a schematic perspective view showing a wire connecting device according to a third embodiment of the present disclosure.
Figure 9:
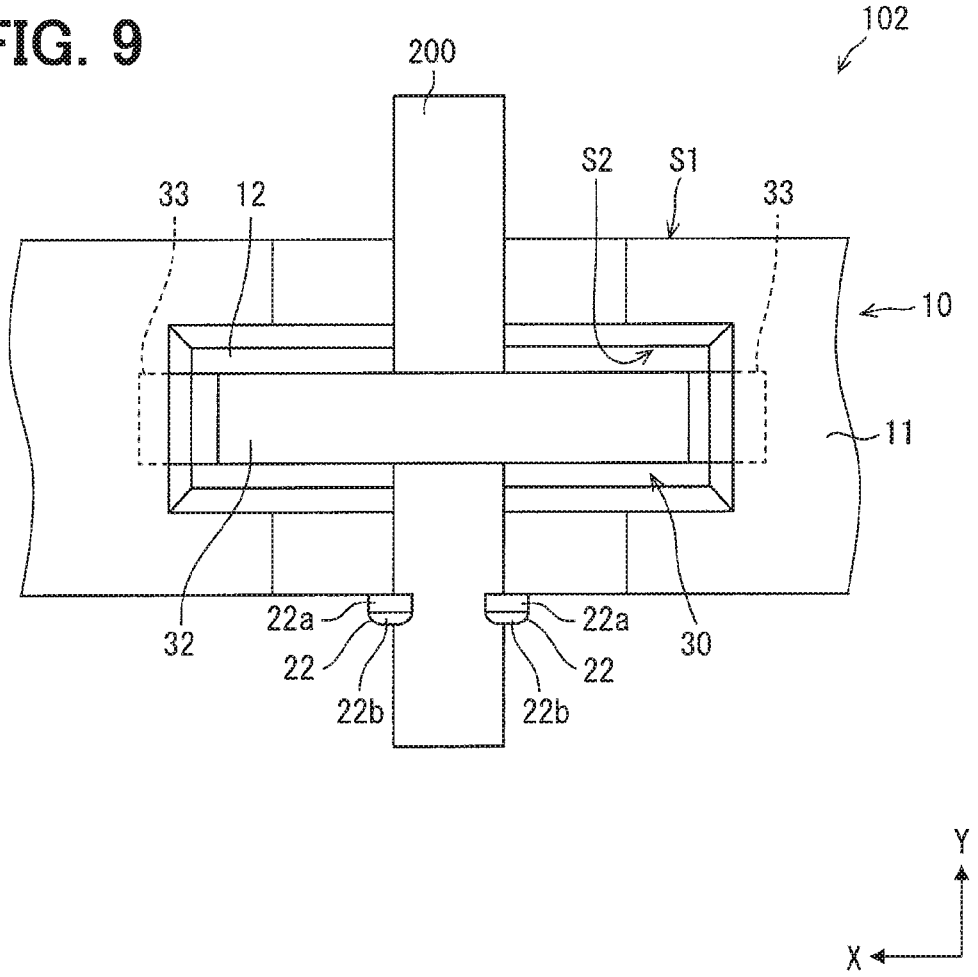
FIG. 9 is a schematic top plane view showing the wire connecting device of the third embodiment.

As shown in FIGS. 8 and 9, the wire connecting device 102 has the wire stopper portions 22, which are integrally formed with the holder base portion 11 of the terminal holder unit 10 or which are made of separate parts and fixed to the outer wall surface S1 of the holder base portion 11 by the adhesive material. As more clearly shown in FIG. 9, the wire stopper portion 22 includes a base-side portion **22*a* on a side closer to the outer wall surface S1 in the Y-direction and a forward-side portion 22*b* on a side to the forward end of the wire stopper portion 22. A curvature radius of the base-side portion 22*a* is larger than that of the forward-side portion 22*b***, when viewed them in the Y-direction.

As above, the wire stopper portion 22 includes the base-side portion **22*a* formed in a columnar shape and the forward-side portion 22*b* formed in a frustum of a circular cone continuously connected to the columnar shape of the base-side portion 22*a*. The base-side portion 22*a* and the forward-side portion 22*b* are integrally formed as one piece. The forward-side portion 22*b* has a circular bottom surface and a circular front surface, a diameter of which is smaller than that of the circular bottom surface. The forward-side portion 22*b* further has an inclined side-wall surface, which is formed in a cylindrical shape connecting the circular base surface to the circular front surface. In addition, the inclined side-wall surface is formed in a curved surface in an axial direction (the Y-direction) of the wire stopper portion 22** from the circular bottom surface to the circular front surface.

The wire connecting device 102 of the present embodiment can obtain the same advantages to those of the wire connecting device 100 of the first embodiment or the wire connecting device 101 of the second embodiment. In the wire connecting device 102, the base-side portion **22*a* of the wire stopper portion 22 is more surely in contact with the covered electric wire 200 than the forward-side portion 22*b*. As explained above, the curvature radius of the base-side portion 22*a*** is larger than that of the forward-side portion 22*b*. A curved surface having a larger curvature radius can more easily avoid stress concentration against a part, with which the curved surface is in contact. As a result, it is possible in the wire connecting device 102 to reduce the stress concentration to the covered electric wire 200 and thereby it is possible to prevent the covered electric wire 200 from its disconnection.

Fourth Embodiment

A wire connecting device 103 of a fourth embodiment will be explained with reference to FIG. 10. The wire connecting device 103 of the fourth embodiment is different from the wire connecting device 101 of the second embodiment in a structure of a wire stopper portion 23.

Figure 10:
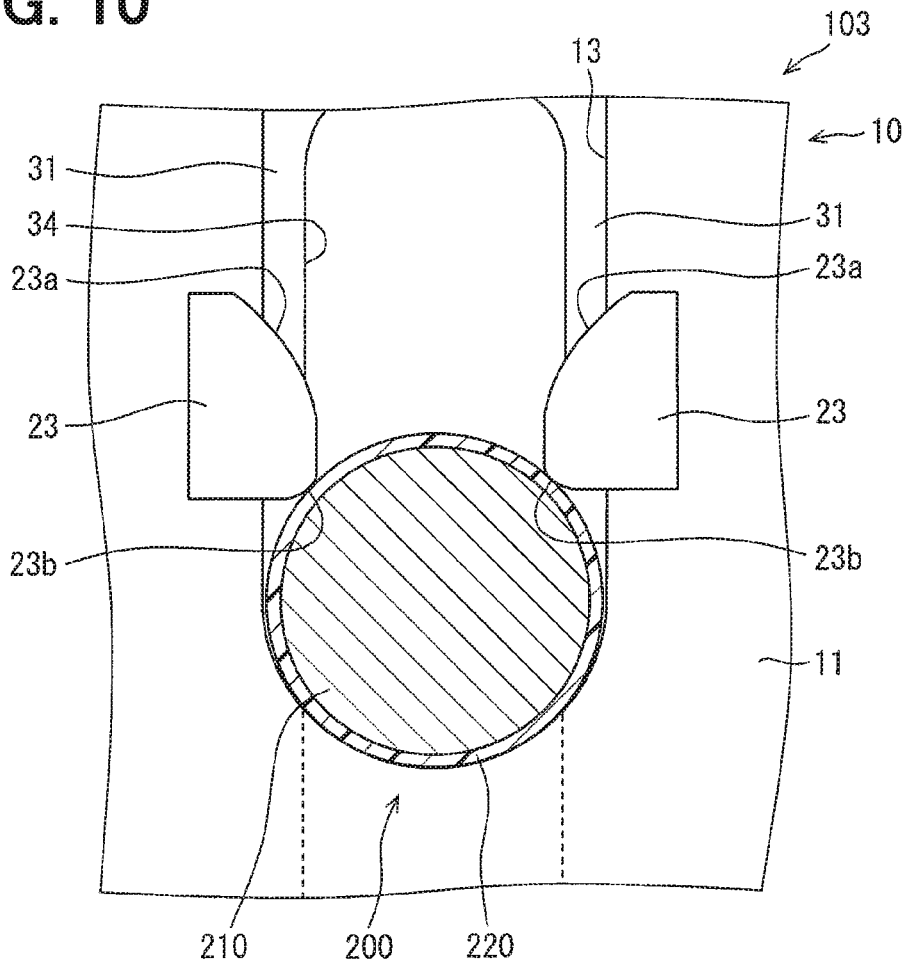
FIG. 10 is a schematically enlarged front view showing relevant portions of a wire connecting device according to a fourth embodiment of the present disclosure.

As shown in FIG. 10, the wire connecting device 103 has the wire stopper portions 23, which are integrally formed with the holder base portion 11 of the terminal holder unit 10 or which are made of separate parts and fixed to the outer wall surface S1 of the holder base portion 11 by the adhesive material. Each of the wire stopper portions 23 has the inside opposing surface opposed to each other in the X-direction. The inside opposing surface has an upper-side curved surface portion 23*a* (a first curved surface portion 23*a*) on a side closer to the upper-side open end of the holder-side groove 13 and a lower-side curved surface portion 23*b* (a second curved surface portion 23*b*) on a side closer to the bottom end of the holder-side groove 13. A curvature radius of the upper-side curved surface portion 23*a* is larger than that of the lower-side curved surface portion 23*b*, when viewed them in the Y-direction.

As above, the inside opposing surface of the wire stopper portion 23 includes the upper-side and the lower-side curved surface portions 23*a* and 23*b* having different curvature radiuses, wherein the upper-side and the lower-side curved surface portions 23*a* and 23*b* are located in an area of the holder-side groove 13 in which they are opposed to each other in the X-direction. In addition, the curvature radius of the lower-side (the second) curved surface portion 23*b* is smaller than that of the upper-side (the first) curved surface portion 23*a*.

The wire connecting device 103 of the present embodiment can obtain the same advantages to those of the first embodiment. Since the curvature radius of the upper-side curved surface portion 23*a* is larger than that of the lower-side curved surface portion 23*b*, it is possible to smoothly insert the covered electric wire 200 with a smaller press-insert force into the holder-side groove 13, more exactly to the wire assembled position between the wire stopper portions 23 and the bottom end of the holder-side groove 13. In other words, in the wire connecting device 103 of the present embodiment, it is possible to insert the covered electric wire 200 to the wire assembled position by the press-insert force smaller than that of the wire connecting device 101 of the second embodiment. In addition, when compared the press-insert force of the present embodiment with a pulling-out force for puling out the covered electric wire 200 from the wire assembled position to an outside of the holder-side groove 13 over the wire stopper portions 23, it is possible in the present embodiment to make the press-insert force smaller than the pulling-out force.

In addition, since the curvature radius of the lower-side curved surface portion 23*b* is smaller than that of the upper-side curved surface portion 23*a*, it is possible to increase the pushing force from the wire stopper portions 23 to the covered electric wire 200. In other words, in the wire connecting device 103 of the present embodiment, it is possible to make the pushing force from the wire stopper portions 23 to the covered electric wire 200 larger than that in the wire connecting device 101 of the second embodiment. As a result, it becomes easier in the wire connecting device 103 to firmly hold the covered electric wire 200 in the wire assembled position of the holder-side groove 13 (the position between the wire stopper portions 23 and the bottom end of the holder-side groove 13).

Fifth Embodiment

Figure 11B:
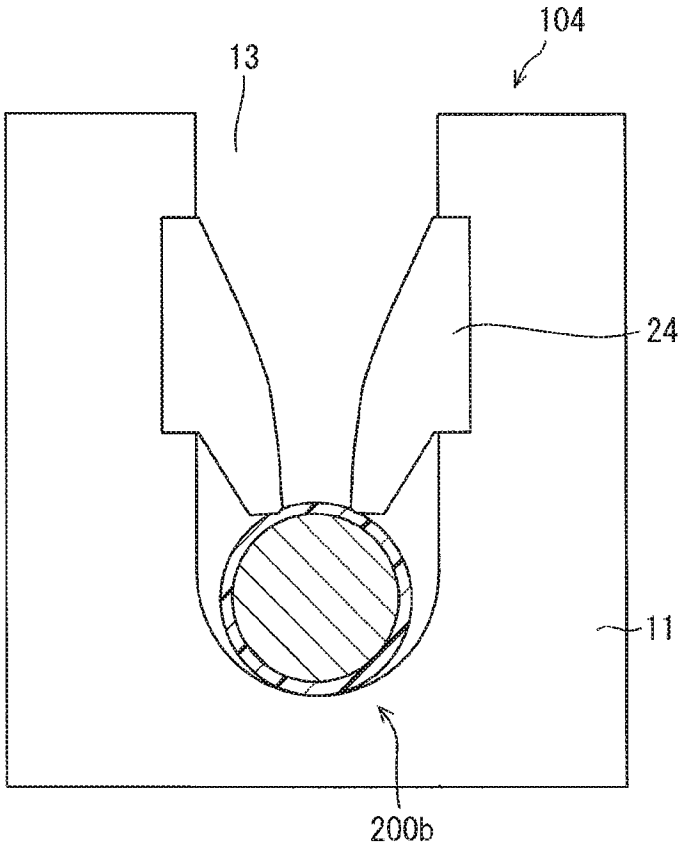
FIGS. 11A and 11B are schematic front views for explaining a wire assembled condition of a covered electric wire having a different diameter, wherein each of the drawings shows relevant portions of a wire connecting device according to a fifth embodiment of the present disclosure.

A wire connecting device 104 of a fifth embodiment will be explained with reference to FIGS. 11A and 11B. The wire connecting device 104 of the fifth embodiment is different from the wire connecting device 100 of the first embodiment in a structure of a wire stopper portion 24.

Figure 11A:
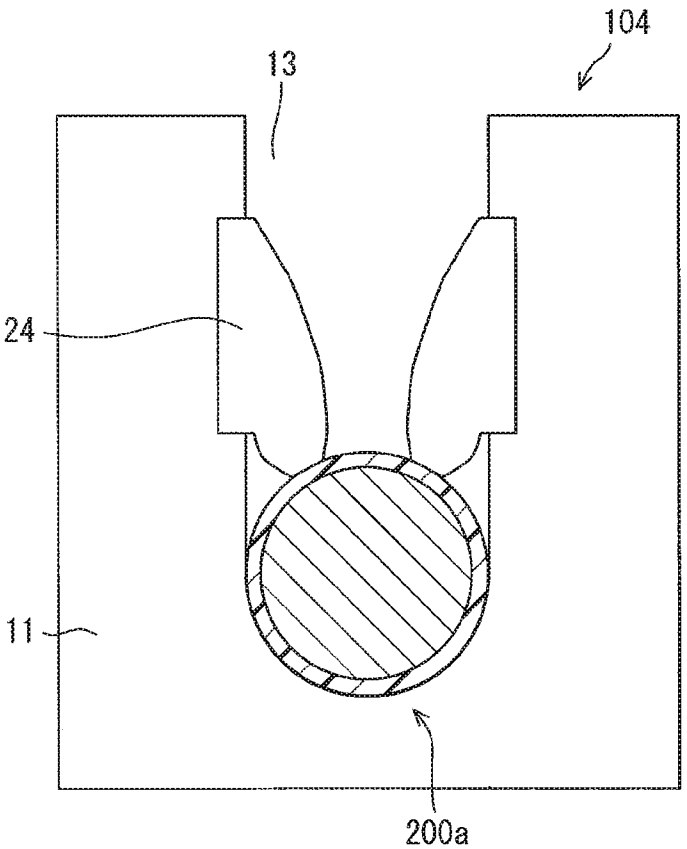

FIG. 11A is a schematic view showing the wire connecting device 104, in which a covered electric wire 200*a* having a large diameter is inserted into the holder-side groove 13. FIG. 11B is a schematic view showing the wire connecting device 104, in which a covered electric wire 200*b* having a small diameter is inserted into the holder-side groove 13. The diameter of the covered electric wire 200*b* is smaller than that of the covered electric wire 200*a*.

The wire stopper portions 24 are made of elastic material, such as rubber, as separate parts from the holder base portion 11 of the terminal holder unit 10 and fixed to the outer wall surface S1 of the holder base portion 11 by the adhesive material. Each of the wire stopper portions 24 is capable of being elastically deformed, when the covered electric wire 200*a*/200*b* is press-inserted into the holder-side groove 13. As shown in FIGS. 11A and 11B, a deformed shape of the wire stopper portion 24 is different from each other depending on the diameter of the covered electric wire 200*a*/200*b*.

The wire connecting device 104 of the present embodiment can obtain the same advantages to those of the wire connecting device 100 of the first embodiment. In addition, since the wire stopper portions 24 are made of the elastic material, it is possible to stably and surely hold the covered electric wire 200*a*/200*b* in the wire assembled position, even when the diameter of the covered electric wire 200*a*/200*b* is different from each other. In other words, even in the same structure of the wire connecting device 104, it is possible to surely prevent the covered electric wire 200*a*/200*b* having the different diameter from being displaced from the wire assembled position (the position between the wire stopper portions 24 and the bottom end of the holder-side groove 13) in the Z-direction to the upper-side open end of the holder-side groove 13.

In the present embodiment, the covered electric wires 200*a* and 200*b* having the different diameters from each other can be surely inserted into the holder-side groove 13 of the terminal holder unit 10. However, even in a case that the covered electric wire having the same diameter is used, the diameter of the covered electric wire may be changed depending on ambient temperature. Even in such a case, it is possible in the present embodiment to surely hold the covered electric wire in the wire assembled position at the bottom end of the holder-side groove 13.

Sixth Embodiment

Figure 12B:
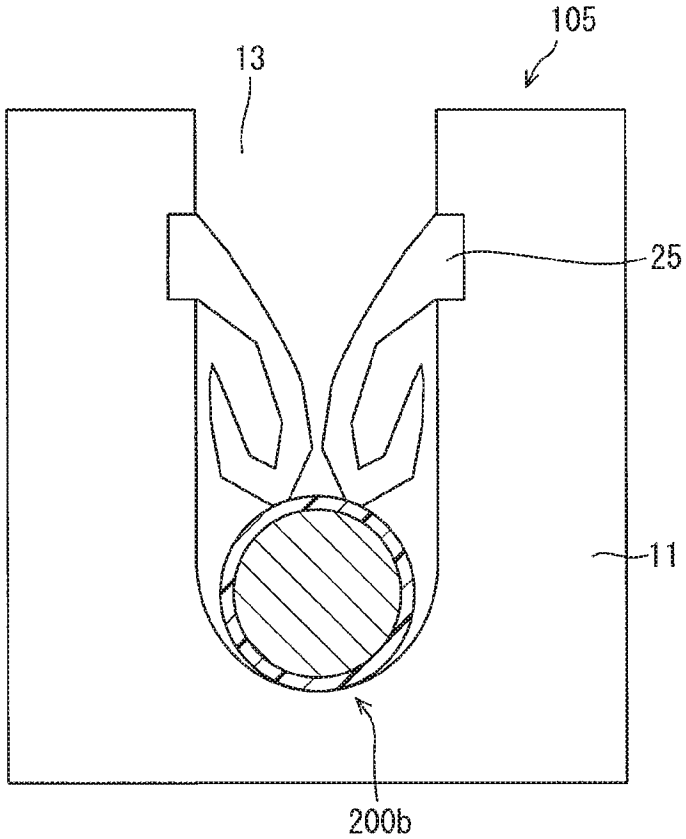
FIGS. 12A and 12B are schematic front views for explaining a wire assembled condition of a covered electric wire having a different diameter, wherein each of the drawings shows relevant portions of a wire connecting device according to a sixth embodiment of the present disclosure.
Figure 12A:
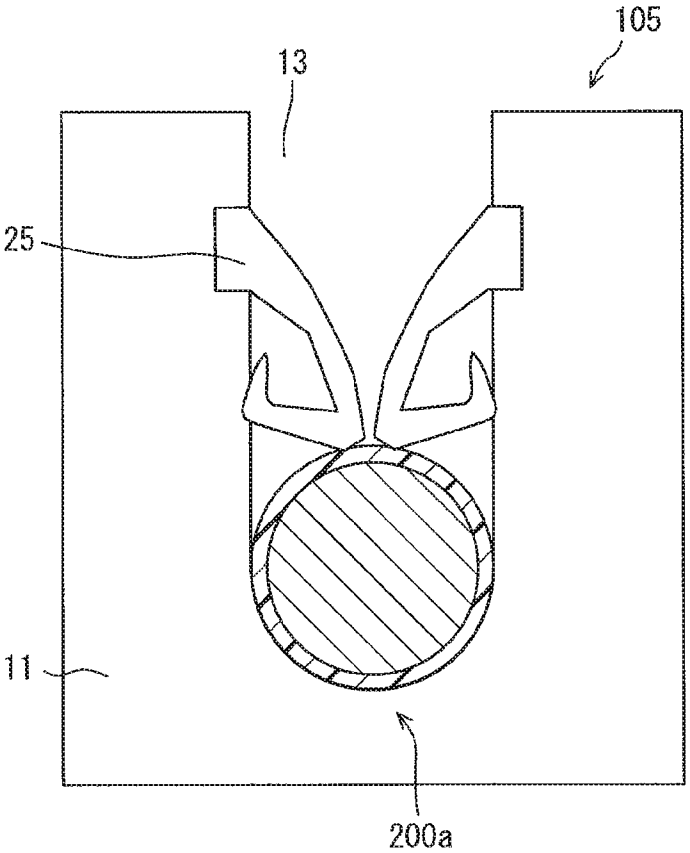

A wire connecting device 105 of a sixth embodiment will be explained with reference to FIGS. 12A and 12B. The wire connecting device 105 of the sixth embodiment is different from the wire connecting device 104 of the fifth embodiment in a structure of a wire stopper portion 25.

In a similar manner to the wire connecting device 104 of the fifth embodiment, the wire stopper portions 25 of the sixth embodiment are made of elastic material (for example, metal) as separate parts from the holder base portion 11 of the terminal holder unit 10 and fixed to the outer wall surface S1 of the holder base portion 11 by the adhesive material. As shown in FIGS. 12A and 12B, each of the wire stopper portions 25 has an L-shaped arm portion, which is deformable in the X-direction so that the wire stopper portion 25 has a spring structure. Therefore, each of the wire stopper portions 25 is capable of being elastically deformed, when the covered electric wire 200*a*/200*b* is press-inserted into the holder-side groove 13. As shown in FIGS. 12A and 12B, a deformed shape of the wire stopper portion 25 is different from each other depending on the diameter of the covered electric wire 200*a*/200*b*. The wire connecting device 105 of the present embodiment has the same advantages to those of the wire connecting device 104 of the fifth embodiment.

Seventh Embodiment

Figure 13:
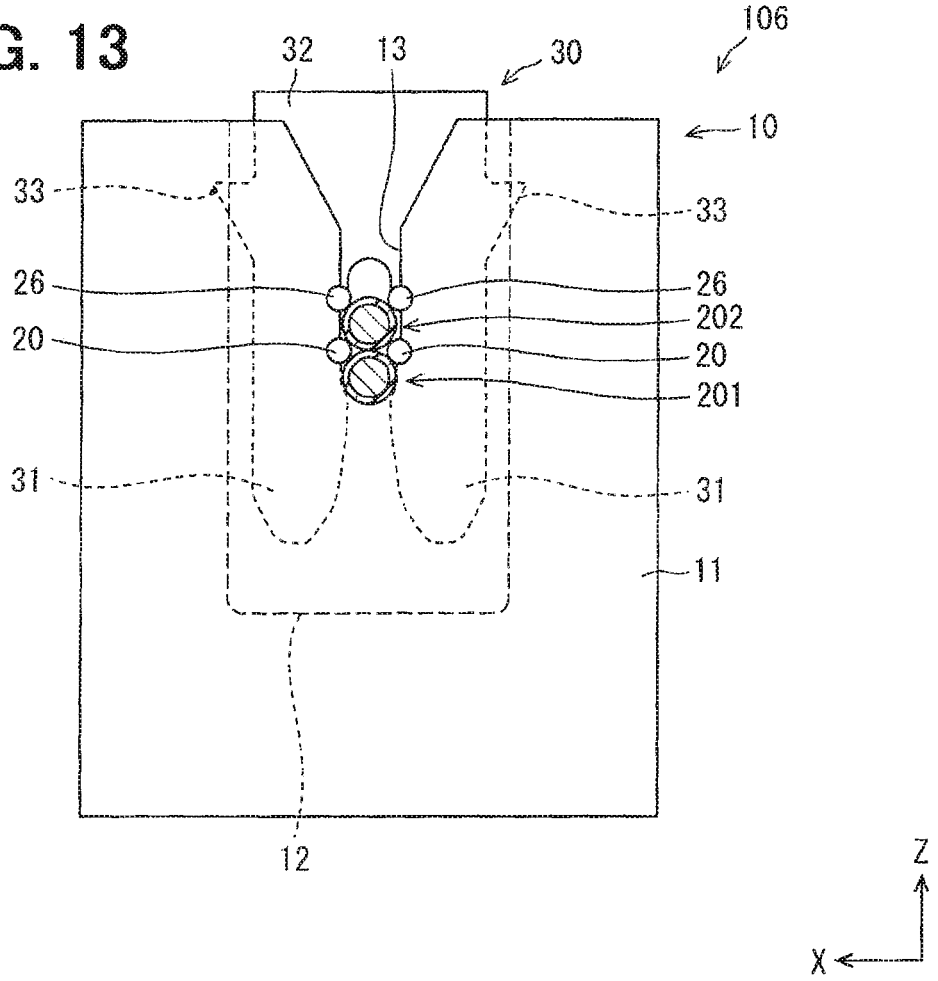
FIG. 13 is a schematic front view showing a wire connecting device according to a seventh embodiment of the present disclosure.

A wire connecting device 106 of a seventh embodiment will be explained with reference to FIG. 13. The wire connecting device 106 of the seventh embodiment is different from the wire connecting device 100 of the first embodiment in that two covered electric wires 201 and 202 are inserted into the holder-side groove 13 and second wire stopper portions 26 are provided in addition to the (first) wire stopper portions 20.

In the wire connecting device 106 of the present embodiment, two covered electric wires, that is, the first covered electric wire 201 and the second covered electric wire 202, are inserted into the holder-side groove 13. More exactly, the first covered electric wire 201 is located at a first wire assembled position, which is the position between the first wire stopper portions 20 and the bottom end of the holder-side groove 13. The second covered electric wire 202 is located at a second wire assembled position, which is directly above the first wire assembled position in the Z-direction. The wire connecting device 106 has the second wire stopper portions 26 in addition to the first wire stopper portions 20. The first and the second covered electric wires 201 and 202 are collectively referred to as the covered electric wire. The first and the second wire stopper portions 20 and 26 are collectively referred to as the wire stopper portions.

A pair of the first wire stopper portions 20 is provided for the first covered electric wire 201, while a pair of the second wire stopper portions 26 is provided for the second covered electric wire 202. Each of the first wire stopper portions 20 is located at an upper-side position of the first covered electric wire 201, that is, on a side of the first covered electric wire 201 in the Z-direction closer to the upper-side open end of the holder-side groove 13. In a similar manner, each of the second wire stopper portions 26 is located at an upper-side position of the second covered electric wire 202, that is, on a side of the second covered electric wire 202 in the Z-direction closer to the upper-side open end of the holder-side groove 13. The first wire stopper portions 20 are located at such a position, at which the first wire stopper portions 20 prevent the first covered electric wire 201 from being moved in the Z-direction from the first wire assembled position to the upper-side open end of the holder-side groove 13.

The second wire stopper portions 26 are provided at the position different from that of the first wire stopper portions 20 in the Z-direction. The other structures and functions of the second wire stopper portions 26 than the position thereof are the same to those of the first wire stopper portions 20. The second wire stopper portions 26 are located at such positions, at which the second wire stopper portions 26 prevent the second covered electric wire 202 from being moved in the Z-direction from its second wire assembled position to the upper-side open end of the holder-side groove 13. In other words, each of the second wire stopper portions 26 is located at such a position, which is separated in the Z-direction from a top point of the first covered electric wire 201 (that is, an upper-most point on the side closer to the upper-side open end of the holder-side groove 13) by a distance smaller than a diameter of the second covered electric wire 202. For example, a virtual line connecting center axes of the neighboring second wire stopper portions 26 in the X-direction is located at a position in such a manner that a distance in the Z-direction between the virtual line and the top point of the first covered electric wire 201 is equal to or smaller than the diameter of the second covered electric wire 202. Accordingly, the second wire stopper portions 26 are provided at such positions, at which the second wire stopper portions 26 can push the second covered electric wire 202 in the Z-direction to the first covered electric wire 201.

The wire connecting device 106 of the present embodiment can obtain the same advantages to those of the first embodiment. In addition, in the wire connecting device 106 in which the multiple covered electric wires (two covered electric wires 201 and 202) are assembled to the holder-side groove 13, it is possible to prevent each of the covered electric wires from being displaced in the Z-direction from the respective wire assembled position to the upper-side open end of the holder-side groove 13.

In the present embodiment, the two covered electric wires 201 and 202 are assembled to the terminal holder unit 10. However, the present disclosure is not limited to the two covered electric wires. The multiple covered electric wires more than two may be assembled to the terminal holder unit. In such a case, multiple wire stopper portions may be provided in proportion to the number of the covered electric wires, in order to firmly hold each of the covered electric wires at respective wire assembled position by each of the wire stopper portions.

Eighth Embodiment

Figure 14:
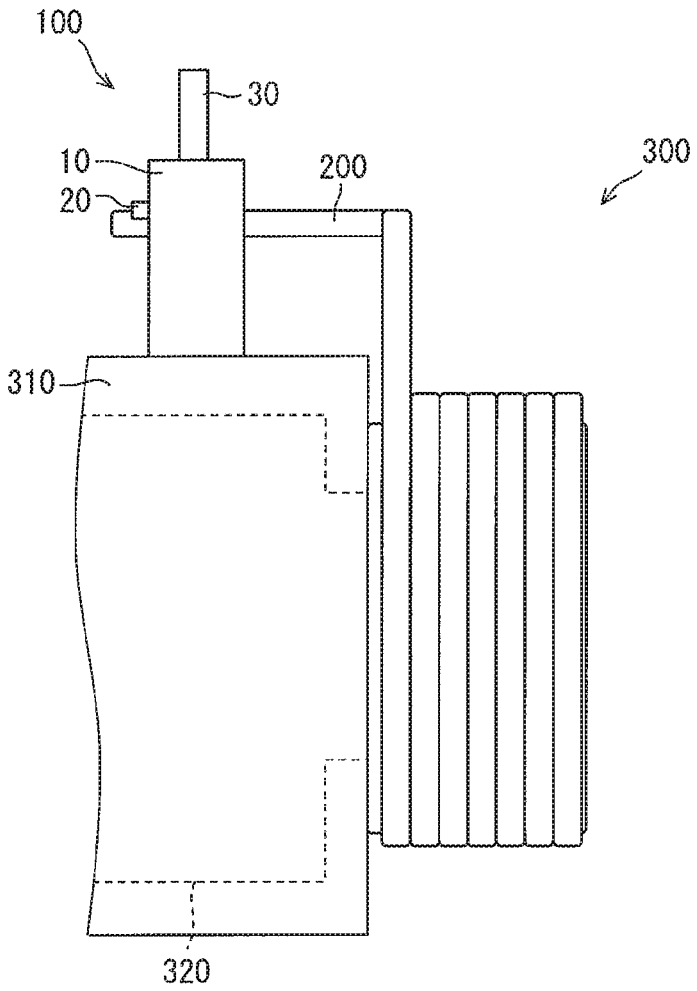
FIG. 14 is a schematic side view showing a wire connecting device applied to an electric actuating device according to an eighth embodiment of the present disclosure.

The wire connecting device 100 of an eighth embodiment will be explained with reference to FIG. 14. The wire connecting device 100 of the eighth embodiment is different from the wire connecting device 100 of the first embodiment in that the wire connecting device 100 is integrally assembled to an actuator 300. FIG. 14 shows only a part of the actuator 300.

The actuator 300 is composed of, for example, an electric actuating device, which includes an insulator 310 and magnetic steel sheets 320. The covered electric wire 200 is electrically connected to the actuator 300.

The insulator 310 electrically insulates the covered electric wire 200 from the magnetic steel sheets 320. The insulator 310 is a part of the actuator 300, which is mainly made of resin. The insulator 310 is integrally formed with the terminal holder unit 10 as one integral part of the actuator 300, for example, by a resin molding process.

The insulator 310 and the terminal holder unit 10 are integrally manufactured at the same time by the same molding die. In other words, the insulator 310 and the terminal holder unit 10 can be manufactured in the same manufacturing process.

The wire connecting device 100 of the present embodiment can obtain the same advantages to those of the wire connecting device 100 of the first embodiment. Since the terminal holder unit 10 is integrally formed with the insulator 310 in the present embodiment, it is not necessary to separately prepare the terminal holder unit 10 from the insulator 310. In the present embodiment, therefore, it is possible to manufacture the wire connecting device 100 at a lower cost than a case in which the terminal holder unit 10 is separately manufactured as an independent part of the actuator 300.

Ninth Embodiment

A wire connecting device 107 of a ninth embodiment will be explained with reference to FIGS. 15 to 18. The wire connecting device 107 of the ninth embodiment is different from the wire connecting device 100 of the first embodiment in that wire stopper portions 35 are formed in a press-insert terminal 30*a*. In other words, the wire connecting device 107 of the present embodiment is different from the wire connecting device 100 of the first embodiment in that a structure corresponding to the wire stopper portions 20 of the first embodiment is not provided in the terminal holder unit 10 of the present embodiment.

Figure 15:
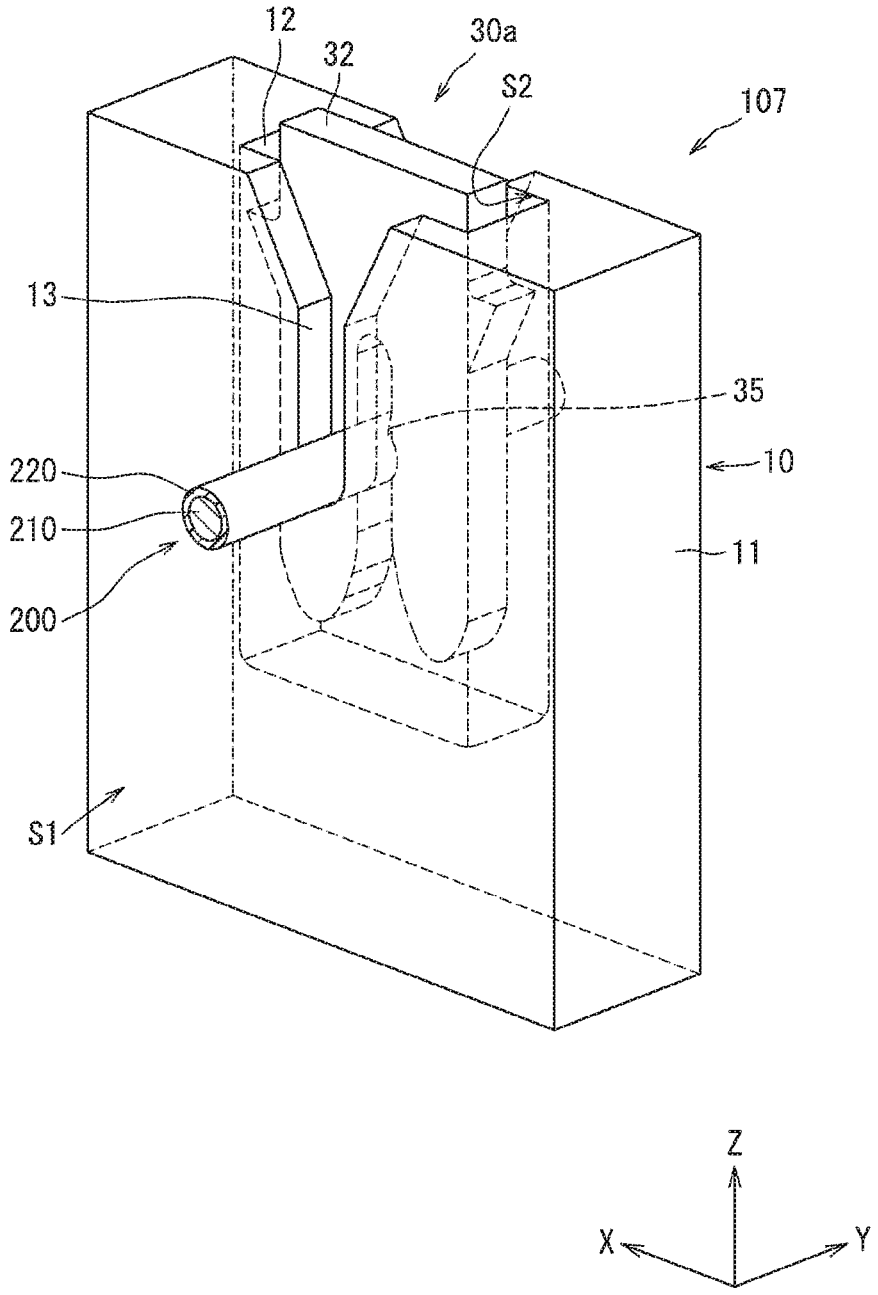
FIG. 15 is a schematic perspective view showing a wire connecting device according to a ninth embodiment of the present disclosure.
Figure 16:
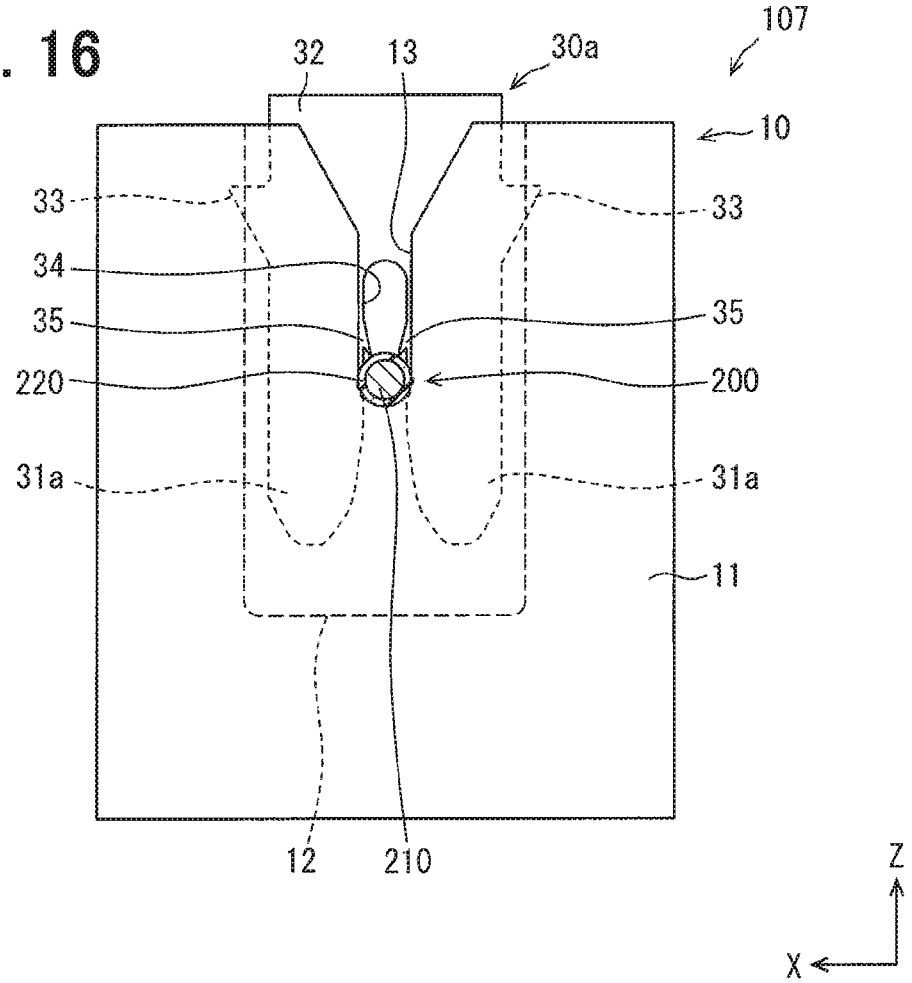
FIG. 16 is a schematic front view showing the wire connecting device of the ninth embodiment.
Figure 17:
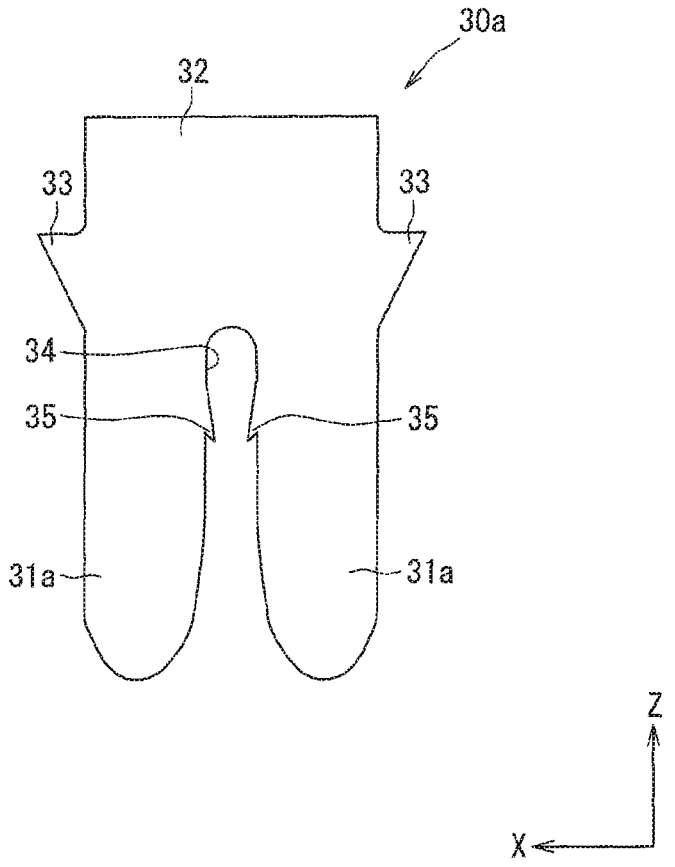
FIG. 17 is a schematic front view showing a press-insert terminal of the ninth embodiment.
Figure 18:
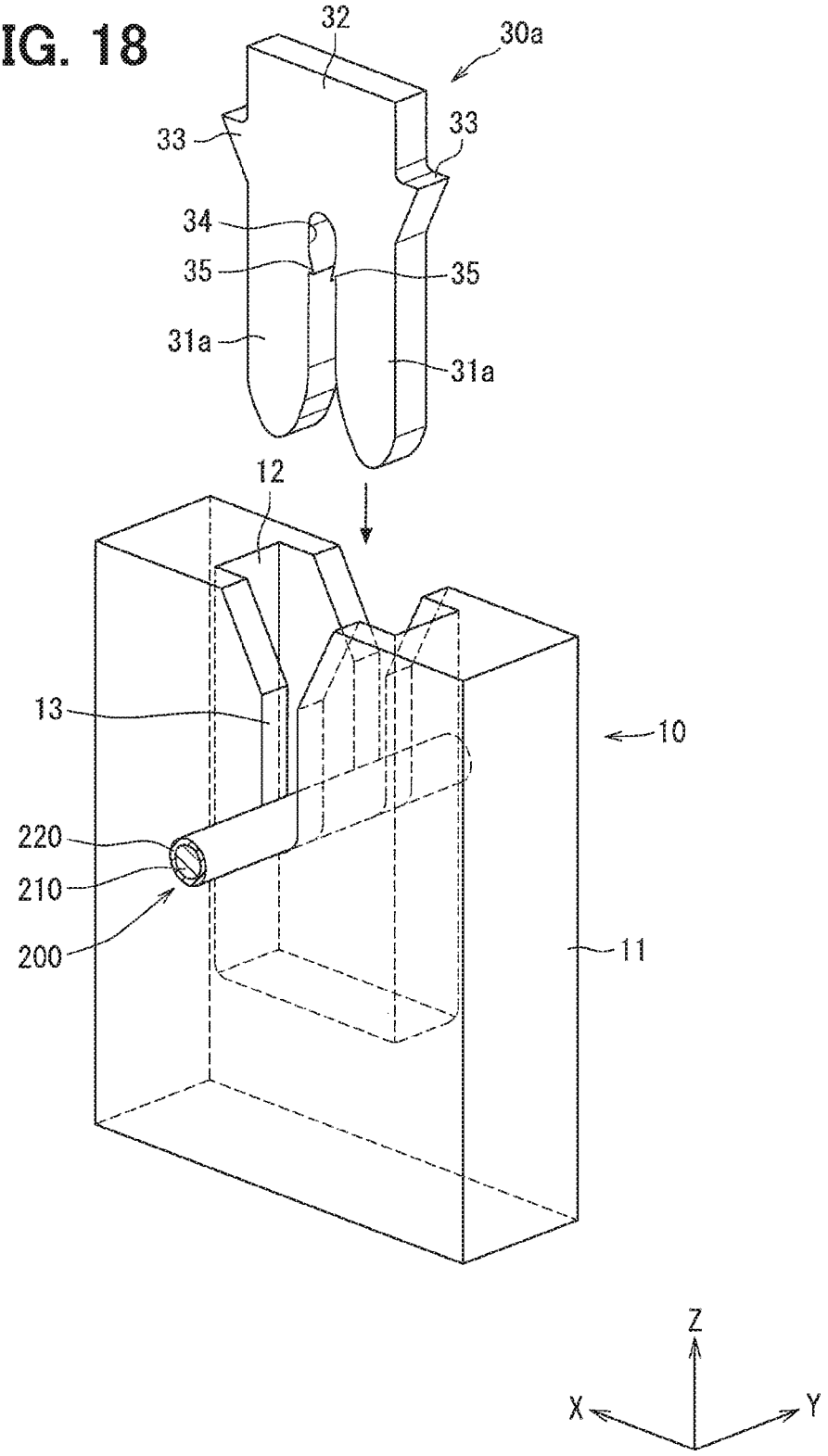
FIG. 18 is a schematic perspective view showing an assembling process for the wire connecting device of the ninth embodiment.

As shown in FIGS. 15, 16 and 18, the wire connecting device 107 includes the terminal holder unit 10 and the press-insert terminal 30*a*. As shown in FIG. 17, the press-insert terminal 30*a* has the terminal-side groove 34 in which the covered electric wire 200 is arranged in the wire assembled condition. In addition, the press-insert terminal 30*a* includes a pair of cutting portions 31*a* opposed to each other in the X-direction across the terminal-side groove 34. Each of the cutting portions 31*a* is connected to each other via the connecting portion 32. A part of the insulating coating portion 220 of the covered electric wire 200 is removed when the press-insert terminal 30*a* is press-inserted into the terminal accommodation space 12 of the terminal holder unit 10 and the cutting portions 31*a* are strongly press-contacted to the covered electric wire 200. As a result, the part of the conductive wire portion 210 of the covered electric wire 200 is exposed to the outside thereof. Therefore, the cutting portions 31*a* are partly and electrically in contact with the conductive wire portion 210 at the portions exposed to the outside. As shown in FIGS. 15 and 18, the press-insert terminal 30*a* is assembled to the terminal accommodation space 12 of the terminal holder unit 10.

Each of the cutting portions 31*a* has the wire stopper portion 35, which is inwardly protruded in the X-direction so that the wire stopper portions 35 are opposed to each other in the X-direction. The wire stopper portions 35 are formed at such positions of the cutting portions 31*a* at which the wire stopper portions 35 can limit the movement of the covered electric wire 200 in the Z-direction from the wire assembled position to the upper-side open end of the holder-side groove 13, in the condition that the covered electric wire 200 is inserted into the holder-side groove 13 and firmly held by the press-insert terminal 30*a* at the wire assembled position. The cutting portions 31*a* of the press-insert terminal 30*a* are press-contacted to the covered electric wire 200, in the condition that the covered electric wire 200 is assembled to the terminal holder unit 10, so that the wire stopper portions 35 press the covered electric wire 200 to the bottom end of the holder-side groove 13.

In the present embodiment, each of the wire stopper portions 35 has a forward end having a sharp edge. It is possible that the sharp edge of the wire stopper portion 35 cuts deep into the insulating coating portion 220 and thereby the wire stopper portion 35 is also electrically connected to the conductive wire portion 210. As above, in the present embodiment, not only the cutting portions 31*a* but also the wire stopper portions 35 are electrically connected to the conductive wire portion 210 of the covered electric wire 200. In other words, the sharp edge of the wire stopper portion 35 is electrically connected to the conductive wire portion 210 in addition to and at a different position from the part of the cutting portion 31*a*. As above, in the wire connecting device 107, the press-insert terminal 30*a* can be surely and electrically connected to the covered electric wire 200. However, the present disclosure is not limited to the present embodiment having the sharp edge at the wire stopper portion 35. The wire stopper portion 35 may have a forward end having a shape other than the sharp edge.

As explained above, in the wire connecting device 107 of the present embodiment, the covered electric wire 200 is supported in the holder-side groove 13 of the terminal holder unit 10. In addition, the press-insert terminal 30*a* has the wire stopper portions 35 at each of the cutting portions 31*a*, which are opposed to each other in the X-direction. The wire stopper portions 35 limit the movement of the covered electric wire 200 in the Z-direction from the wire assembled position to the upper-side open end of the holder-side groove 13, in the condition that the covered electric wire 200 is assembled to the terminal accommodation space 12 of the terminal holder unit 10. It is thereby possible to prevent the covered electric wire 200 from being displaced from the wire assembled position to the upper-side open end of the holder-side groove 13.

When compared the present embodiment, in which the wire stopper portions 35 are formed in the cutting portions 31*a* of the press-insert terminal 30*a*, with the other embodiments in which the wire stopper portions (for example, the wire stopper portions 20 of the first embodiment) are formed in the holder base portion 11 of the terminal holder unit 10, it is possible in the present embodiment to make larger the pushing force of the wire stopper portions 35 to the covered electric wire 200. As a result, it is possible in the wire connecting device 107 of the present embodiment to absorb a larger displacement of the covered electric wire 200, when compared with the other embodiments in which the wire stopper portions are provided in the terminal holder unit 10.

The present embodiment can be implemented in combination with the fifth or the sixth embodiment. More exactly, the wire stopper portions 35 may be formed as the separate parts from the cutting portions 31*a*, wherein the wire stopper portions 35 are made of the elastic material and/or may have the spring structure. Even in such a combination, the wire connecting device 107 can obtain the same advantages to those of the wire connecting device 104 of the fifth embodiment or the wire connecting device 105 of the sixth embodiment, in addition to the advantages of the ninth embodiment.

In addition, the present embodiment can be implemented in combination with the eighth embodiment. Namely, the covered electric wire 200 may be electrically connected to the actuator 300 having the insulator 310, wherein the terminal holder unit 10 is integrally formed with the insulator 310.

The present disclosure is not limited to the above embodiments and/or modifications but can be further modified in various manners without departing from a spirit of the present disclosure.

What is claimed is:

1. A wire connecting device comprising:

(i) a terminal holder unit for holding a covered electric wire and including:

a holder base portion;

a terminal accommodation space formed in the holder base portion;

an inner wall surface of the holder base portion for defining the terminal accommodation space;

an outer wall surface formed at a wall of the holder base portion;

a holder-side groove passing through the wall of the holder base portion in a wire extending direction from the inner wall surface to the outer wall surface and connected to the terminal accommodation space, the holder-side groove accommodating the covered electric wire in the wire extending direction;

(ii) a press-insert terminal having a cutting portion, the press-insert terminal being press-inserted into the terminal accommodation space in a terminal insertion direction in such a way that the cutting portion is press-contacted to the covered electric wire, a part of an insulating coating portion of the covered electric wire is thereby removed, a part of a conductive wire portion of the covered electric wire is exposed to an outside of the covered electric wire, and the press-insert terminal is electrically connected to the part of the conductive wire portion of the covered electric wire exposed to the outside; and (iii) a pair of wire stopper portions formed in the holder base portion at both sides of the holder-side groove in a stopper arranged direction and limiting a movement of the covered electric wire in the terminal insertion direction from a wire assembled position at a bottom end of the holder-side groove to an open end of the holder-side groove, wherein each of the wire stopper portions is outwardly protruded from the outer wall surface of the holder base portion in the wire extending direction, a distance between neighboring wire stopper portions in the stopper arranged direction is smaller than a width of the holder-side groove in the stopper arranged direction, each of the wire stopper portions has an inside opposing surface opposed to each other in the stopper arranged direction over the holder-side groove, the inside opposing surface includes:

a first curved surface portion on a side closer to the open end of the holder-side groove in the terminal insertion direction; and a second curved surface portion on a side closer to the bottom end of the holder-side groove in the terminal insertion direction, and a curvature radius of the second curved surface portion is smaller than that of the first curved surface portion, when viewed in the wire extending direction.

2. A wire connecting device comprising:

(i) a terminal holder unit for holding a covered electric wire and including:

a holder base portion;

a terminal accommodation space formed in the holder base portion;

an inner wall surface of the holder base portion for defining the terminal accommodation space;

an outer wall surface formed at a wall of the holder base portion;

a holder-side groove passing through the wall of the holder base portion in a wire extending direction from the inner wall surface to the outer wall surface and connected to the terminal accommodation space, the holder-side groove accommodating the covered electric wire in the wire extending direction;

(ii) a press-insert terminal having a cutting portion, the press-insert terminal being press-inserted into the terminal accommodation space in a terminal insertion direction in such a way that the cutting portion is press-contacted to the covered electric wire, a part of an insulating coating portion of the covered electric wire is thereby removed, a part of a conductive wire portion of the covered electric wire is exposed to an outside of the covered electric wire, and the press-insert terminal is electrically connected to the part of the conductive wire portion of the covered electric wire exposed to the outside; and (iii) wire stopper portions formed in the holder base portion at both sides of the holder-side groove in a stopper arranged direction and limiting a movement of the covered electric wire in the terminal insertion direction from a wire assembled position at a bottom end of the holder-side groove to an open end of the holder-side groove, wherein each of the wire stopper portions is outwardly protruded from the outer wall surface of the holder base portion in the wire extending direction, a distance between neighboring wire stopper portions in the stopper arranged direction is smaller than a width of the holder-side groove in the stopper arranged direction, multiple covered electric wires are inserted into the holder-side groove, the multiple covered electric wires include a first covered electric wire and a second covered electric wire, wherein the second covered electric wire is located at a position above the first covered electric wire in the terminal insertion direction, multiple wire stopper portions are provided for each of the covered electric wires, a first pair of the wire stopper portions is provided at positions on a side of the first covered electric wire closer to the open end of the holder-side groove, so that the first pair of the wire stopper portions is in contact with the first covered electric wire for limiting a movement of the first covered electric wire from its wire assembled position to the open end of the holder-side groove in the terminal insertion direction, and a second pair of the wire stopper portions is provided at positions on a side of the second covered electric wire closer to the open end of the holder-side groove, so that the second pair of the wire stopper portions is in contact with the second covered electric wire for limiting a movement of the second covered electric wire from its wire assembled position to the open end of the holder-side groove in the terminal insertion direction.

3. A wire connecting device comprising:

(i) a terminal holder unit for holding a covered electric wire and including:

a holder base portion;

a terminal accommodation space formed in the holder base portion;

an inner wall surface of the holder base portion for defining the terminal accommodation space;

an outer wall surface formed at a wall of the holder base portion;

a holder-side groove passing through the wall of the holder base portion in a wire extending direction from the inner wall surface to the outer wall surface and connected to the terminal accommodation space, the holder-side groove accommodating the covered electric wire in the wire extending direction;

(ii) a press-insert terminal having a cutting portion, the press-insert terminal being press-inserted into the terminal accommodation space in a terminal insertion direction in such a way that the cutting portion is press-contacted to the covered electric wire, a part of an insulating coating portion of the covered electric wire is thereby removed, a part of a conductive wire portion of the covered electric wire is exposed to an outside of the covered electric wire, and the press-insert terminal is electrically connected to the part of the conductive wire portion of the covered electric wire exposed to the outside; and (iii) wire stopper portions formed in the holder base portion at both sides of the holder-side groove in a stopper arranged direction and limiting a movement of the covered electric wire in the terminal insertion direction from a wire assembled position at a bottom end of the holder-side groove to an open end of the holder-side groove, wherein a front pair of the wire stopper portions is formed at a front-side wall portion of the holder base portion, a rear pair of the wire stopper portions is formed at a rear-side wall portion of the holder base portion, wherein the rear-side wall portion is located on an opposite side to the front-side wall portion in the wire extending direction, each of the wire stopper portions is outwardly protruded from the outer wall surface of the holder base portion in the wire extending direction, and a distance between neighboring wire stopper portions in the stopper arranged direction is smaller than a width of the holder-side groove in the stopper arranged direction.

4. The wire connecting device according to claim 3, wherein each of the wire stopper portions has a forward end and a rear end, the forward end of the wire stopper portion is outwardly protruded from the outer wall surface of the holder base portion in the wire extending direction, and the rear end of the wire stopper portion is inwardly protruded to the holder-side groove in the wire extending direction.

5. The wire connecting device according to claim 3, wherein each of the wire stopper portions is made as a separate part from the holder base portion, and each of the wire stopper portions is attached to the holder base portion by adhesive material.

* * * * *